US009559480B2

(12) United States Patent
Bradley et al.

(10) Patent No.: US 9,559,480 B2
(45) Date of Patent: Jan. 31, 2017

(54) METHOD AND APPARATUS FOR MAKING AN INTERCONNECTION BETWEEN POWER AND SIGNAL CABLES

(71) Applicant: The Phoenix Company of Chicago, Inc., Itasca, IL (US)

(72) Inventors: Robert M. Bradley, Oakville, CT (US); James R. Balistreri, Hemet, CA (US); John E. Maturo, Thomaston, CT (US)

(73) Assignee: The Phoenix Company of Chicago, Inc., Itasca, IL (US)

( * ) Notice: Subject to any disclaimer, the term of this patent is extended or adjusted under 35 U.S.C. 154(b) by 0 days.

(21) Appl. No.: 15/009,874

(22) Filed: Jan. 29, 2016

(65) Prior Publication Data

US 2016/0226203 A1 Aug. 4, 2016

Related U.S. Application Data

(60) Provisional application No. 62/109,380, filed on Jan. 29, 2015.

(51) Int. Cl.
*H01R 43/26* (2006.01)
*H01R 24/60* (2011.01)
*H01R 107/00* (2006.01)

(52) U.S. Cl.
CPC ..... *H01R 43/26* (2013.01); *H01R 24/60* (2013.01); *H01R 2107/00* (2013.01)

(58) Field of Classification Search
CPC ..... H01R 24/38; H01R 9/0506; H01R 9/0515; H01R 24/50
USPC ..... 439/580, 581, 65
See application file for complete search history.

(56) References Cited

U.S. PATENT DOCUMENTS 4,703,394 A * 10/1987 Petit ..... H05K 7/1445 361/790
5,055,068 A * 10/1991 Machura ..... H01R 24/50 439/581
5,645,454 A * 7/1997 Kosmala ..... H01R 24/52 439/607.32
6,224,421 B1 * 5/2001 Maturo, Jr. ..... H01R 13/6315 439/247
6,595,801 B1 * 7/2003 Leonard ..... H01R 13/6485 439/607.11
6,863,565 B1 3/2005 Kogan et al.
6,905,367 B2 * 6/2005 Crane, Jr. ..... H01R 13/514 439/607.01

(Continued)

*Primary Examiner* — Tulsidas C Patel
*Assistant Examiner* — Marcus Harcum
(74) *Attorney, Agent, or Firm* — Robert Curcio; DeLio, Peterson & Curcio, LLC

(57) ABSTRACT

A method, system and apparatus for making an interconnection between power cables and signal cables. A single electrical interface in mid- or backplane applications is introduced to accommodate a wide range of board thickness variations while maintaining a desired interface relationship, using a connector plug bushing, a male connector having a sliding fit with the bushing, a first coaxial connector plug, a female connector plug with a housing width sized to provide a sliding fit within the connector plug bushing inner opening, and a second coaxial connector plug in the free end of the female connector plug for connection to the power and signal cables. A constant impedance connector is used with the interconnection of the RF signal and power cables.

15 Claims, 11 Drawing Sheets

(56) References Cited

U.S. PATENT DOCUMENTS

| | | | | |
|---|---|---|---|---|
| 7,029,286 | B2 * | 4/2006 | Hall | H01R 13/506<br>439/357 |
| 7,563,103 | B1 * | 7/2009 | Hall | H01R 24/50<br>439/581 |
| 7,972,172 | B2 * | 7/2011 | Huang | H01R 9/032<br>439/578 |

* cited by examiner

METHOD AND APPARATUS FOR MAKING AN INTERCONNECTION BETWEEN POWER AND SIGNAL CABLES

BACKGROUND OF THE INVENTION

1. Field of the Invention

The present invention relates to a method, system and apparatus for making an interconnection for power cables and signal cables, particularly coaxial cables for RF signals operating in the range of, but not limited to, 16 GHz to 40 GHz.

2. Description of Related Art

Many electronic applications require extensive radio frequency (RF) cabling. For example a typical RF section on the backplane of an electronic interconnect device may consist of a large number of coaxial cable connections, as well as power cable connections.

Additionally, as underlying electronic components of circuit packs become smaller, the size of coaxial cables and their interconnection may become an impediment to miniaturization of the system.

It should be noted that the above concerns with the use of coaxial cables in a RF distribution fabric are present in many applications that require the use of numerous power and signal cables over a wide frequency range.

SUMMARY OF THE INVENTION

Bearing in mind the problems and deficiencies of the prior art, it is therefore an object of the present invention to provide an interconnection for power and/or signal cables, including RF signals.

The above and other objects, which will be apparent to those skilled in the art, are achieved in the present invention which is directed to an apparatus for making an interconnection for power or signal cables, including RF signals having an operating frequency range of at least about 16 GHz to 40 GHz comprising: a connector plug bushing having an elongated body of a predetermined length between opposite ends, the body having an inner rectangular cross-section opening through the length thereof configured to receive connected male and female connector plugs; a male connector plug housing having a free first end and an opposite second end for connection to a coaxial cable, the male connector plug housing having an outer rectangular cross-section surface at a mid-portion with a width sized to provide a sliding fit within the connector plug bushing inner opening and an outwardly extending flange adjacent the second end, the male connector plug housing outer surface having a length from the flange less than the length of the bushing body, the male connector plug housing having a male portion with a width less than the width of the male connector plug housing outer surface extending therefrom to the male connector plug housing free end; a first coaxial connector plug in the free end of the male connector plug housing for connection to a power or signal cable, such as coaxial cable for RF signals having an operating range of at least about 16 GHz to 40 GHz; a female connector plug housing having a free first end and an opposite second end for connection to a coaxial cable, the female connector plug housing having an outer rectangular cross-section surface extending to the female connector plug housing free end with a width sized to provide a sliding fit within the connector plug bushing inner opening and an outwardly extending flange adjacent the second end, the female connector plug housing outer surface having a length from the flange no greater than the difference between the length of the bushing body and the length of the male connector plug housing outer surface, the female connector plug housing having a female portion of a width less than the width of the female connector plug housing outer surface extending inward from the female connector plug housing free end and sized to receive the male portion of the male connector plug housing; and a second coaxial connector plug in the free end of the female connector plug housing for connection to a power or signal cable, such as coaxial cable for RF signals having an operating range of at least 16 GHz-40 GHz; wherein the free end of one of the male or female connector plug housing may be inserted into the inner opening of the connector plug bushing from one end of the end of the connector plug bushing body until the flange on the male or female connector plug housing contacts the connector plug bushing body; wherein the free end of the other of the male or female connector plug housing may be inserted into the inner opening of the connector plug bushing from the opposite end of the connector plug bushing body until the flange on the other of the male or female connector plug housing contacts the connector plug bushing body; and wherein the male portion of the male connector plug housing may be inserted into the female portion of the female connector plug housing and directly connecting the first and second coaxial connector plugs as a result of the insertion of the male and female connector plug housings into the inner opening of the connector plug bushing to create a connection through the connector plug bushing for power or signal cables, such as coaxial cables for RF signals having an operating range of at least 16 GHz to 40 GHz.

The apparatus may further include a structure receiving and securing the connector plug bushing, wherein, a) the structure receiving and securing the connector plug bushing is a mid- or backplane board having an opening through a thickness of the board, and optionally including one or more additional openings horizontally or vertically arranged thereon, the opening being substantially rectangular and having rigid inward peripheral edges, the board optionally including electrical components mounted thereon; b) the connector plug bushing has an elongated body of a predetermined length between opposite ends sized to be received in the board openings orthogonal to the board, an outer rectangular cross-section slightly smaller than the board opening and an outwardly extending flange at one end thereof larger than the board opening, the bushing body further having at least one resilient outwardly extending tab along at least a portion of the length of and on one or more sides of the bushing body, the tab being sized to provide a friction fit against the edge of the board opening to hold the connector plug bushing within the board opening; c) wherein the connector plug bushing body may be inserted into an opening of the mid- or backplane board orthogonal to the board until the body outwardly extending flange contacts the board, the resilient outwardly extending tab on the bushing body providing a friction fit against the edge of the board opening to secure the connector plug bushing within the board opening; d) the free end of the one of the male or female connector plug housing may be inserted into the inner opening of the connector plug bushing from the end of the connector plug bushing body opposite the flange until the flange on the male or female connector plug housing having the clamp contacts the connector plug bushing body; and e) the free end of the other of the male or female connector plug housing may be inserted into the inner opening of the connector plug bushing from the flange end of the connector plug bushing body until the flange on the other of the male or female connector plug housing contacts the connector plug bushing body.

The connector plug bushing may have an edge, and further including a clamp on the one of the male or female connector plug housing for attachment to the edge on the connector plug bushing; the clamp having a free end with a hook biased for insertion onto the edge on the connector plug bushing; the free end of the one of the male or female connector plug housing having the clamp may be inserted into the inner opening of the connector plug bushing from the end of the connector plug bushing body opposite the flange until the flange on the male or female connector plug housing having the clamp contacts the connector plug bushing body and the hook is inserted onto the bushing body window edge; and the free end of the other of the male or female connector plug housing may be inserted into the inner opening of the connector plug bushing from the end of the connector plug bushing body having the flange until the flange on the other of the male or female connector plug housing contacts the connector plug bushing body.

The first and second coaxial connector plugs form a constant impedance connection, each coaxial connector plug including: an inner contact of having an outer diameter and a free end, an outer contact having an inner diameter and a free end, the inner contact coaxial with the outer contact, the inner and outer contact free ends coincident with the connector free end; a fixed end attachable to a coaxial cable having a dielectric spacer between the inner and outer contacts, and extending up to the outer contact free end; the connector plug housings engaging and electrically connecting the plugs; and wherein the inner and outer contacts of the plugs are shaped, and material for the dielectric spacers is chosen, such that when the connector plug housings engage the plugs along a central axis of the engaged connection the effective outer diameter of the inner contact referenced by "d", the effective inner diameter of the outer contact referenced by "D", and a relative dielectric constant of the medium therebetween referenced by $\epsilon$, satisfy the equation:

$$Z=138(\epsilon)-\tfrac{1}{2}\log(D/d)$$

where

"Z" is the impedance, and the impedance is substantially constant throughout the central axis of the engaged connection; and wherein, on one connector plug, the inner contact free end projects beyond the outer contact free end.

The first coaxial connector plug includes a female connector having a free end and a fixed end, the female connector comprising: an outer contact having an inner diameter D1; an inner contact having an outer diameter d1; a portion of the inner contact extending beyond the outer contact at the female connector's free end and having a diameter d3; and wherein the male connector is adapted to connect with the second coaxial connector plug including the female connector, the male connector having an inner contact with an outer diameter d2, an outer contact with an inner diameter D2, wherein a portion of the outer contact extends beyond the inner contact free end, the portion of the outer contact extending beyond the inner contact having an inner diameter D3; such that when the male connector is at least partially engaged with the female connector, the ratios of the diameters: D1/d1, D2/d2, and D3/d3 are substantially equal.

One of the outer contacts includes a tip having a variable radius, the radius increasing axially to a point of maximum radial length as the tip extends from a lower axial position towards the free end, then decreasing approximately linearly as the tip continues to extend from the point of maximum radial length to the free end.

In a second aspect, the present invention is directed to a method of making an interconnection for power or signal cables, including RF signals having an operating range of at least 16 GHz to 40 GHz comprising: providing a connector plug bushing having an elongated body of a predetermined length between opposite ends, the body having an inner rectangular cross-section opening through the length thereof configured to receive connected male and female connector plugs; providing a male connector plug housing having a free first end and an opposite second end for connection to a coaxial cable, the male connector plug housing having an outer rectangular cross-section surface at a mid-portion with a width sized to provide a sliding fit within the connector plug bushing inner opening and an outwardly extending flange adjacent the second end, the male connector plug housing outer surface having a length from the flange less than the length of the bushing body, the male connector plug housing having a male portion with a width less than the width of the male connector plug housing outer surface extending therefrom to the male connector plug housing free end; providing in the free end of the male connector plug housing a first coaxial connector plug for connection to a power or signal cable, such as coaxial cable for RF signals having an operating range of at least 16 GHz to 40 GHz; providing a female connector plug housing having a free first end and an opposite second end for connection to a coaxial cable, the female connector plug housing having an outer rectangular cross-section surface extending to the female connector plug housing free end with a width sized to provide a sliding fit within the connector plug bushing inner opening and an outwardly extending flange adjacent the second end, the female connector plug housing outer surface having a length from the flange no greater than the difference between the length of the bushing body and the length of the male connector plug housing outer surface, the female connector plug housing having a female portion of a width less than the width of the female connector plug housing outer surface extending inward from the female connector plug housing free end and sized to receive the male portion of the male connector plug housing; providing in the free end of the female connector plug housing a second coaxial connector plug for connection to a power or signal cable, such as coaxial cable for RF signals having an operating range of at least 16 GHz to 40 GHz; inserting the free end of one of the male or female connector plug housing into the inner opening of the connector plug bushing until the flange on the one of the male or female connector plug housing contacts the connector plug bushing body; inserting the free end of the other of the male or female connector plug housing into the inner opening of the connector plug bushing from the opposite end of the connector plug bushing body until the flange on the other of the male or female connector plug housing contacts the connector plug bushing body; and inserting the male portion of the male connector plug housing into the female portion of the female connector plug housing and directly connecting the first and second coaxial connector plugs as a result of the insertion of the male and female connector plug housings into the inner opening of the connector plug bushing to create a connection through the mid- or backplane board for power or signal cables, such as coaxial cables.

In a third aspect, the present invention is directed to a constant impedance connector comprising: first and second coaxial connector plugs, each connector plug having an inner contact of an outer diameter and a free end, an outer contact having an inner diameter and a free end, the inner contact coaxial with the outer contact, the inner and outer contact free ends coincident with the connector free end; a fixed end attachable to a coaxial cable having a dielectric spacer between the inner and outer contacts, and extending up to the outer contact free end; the connector plugs engaging and in electrical communication; and wherein the inner and outer contacts of the plugs are shaped, and material for the dielectric spacers is chosen, such that when the connector engages the plugs along a central axis of the engaged connection the effective outer diameter of the inner contact referenced by "d", the effective inner diameter of the outer contact referenced by "D", and a relative dielectric constant of the medium there between referenced by $\epsilon$, satisfy the equation:

$$Z=138(\epsilon)-\tfrac{1}{2}\log(D/d)$$

where

"Z" is the impedance, and the impedance is substantially constant throughout the central axis of the engaged connection; wherein, on at least one connector plug, the inner contact free end projects beyond the outer contact free end; and wherein one of the outer contacts includes a tip having a variable radius, the radius increasing axially to a point of maximum radial length as the tip extends from a lower axial position towards the free end, then decreasing approximately linearly as the tip continues to extend from the point of maximum radial length to the free end.

In a fourth aspect, the present invention is directed to a constant impedance connector including a male connector plug and a female connector plug, the female connector plug having a free end and a fixed end, the female connector plug comprising: an outer contact having an inner diameter D1; an inner contact having an outer diameter d1; a portion of the inner contact extending beyond the outer contact at the female connector's free end and having a diameter d3; wherein the male connector plug is adapted to connect with the female connector plug, the male connector plug having an inner contact with an outer diameter d2, an outer contact with an inner diameter D2, wherein a portion of the outer contact extends beyond the inner contact free end, the portion of the outer contact extending beyond the inner contact having an inner diameter D3; such that when the male connector is at least partially engaged with the female connector, the ratios of the diameters: D1/d1, D2/d2, and D3/d3 are substantially equal; and wherein an outer contacts of the male plug includes a tip having a variable radius, the radius increasing axially to a point of maximum radial length as the tip extends from a lower axial position towards the free end, then decreasing approximately linearly as the tip continues to extend from the point of maximum radial length to the free end.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-30 of the drawings in which like numerals refer to like features of the invention.

Figures 1, 1A:
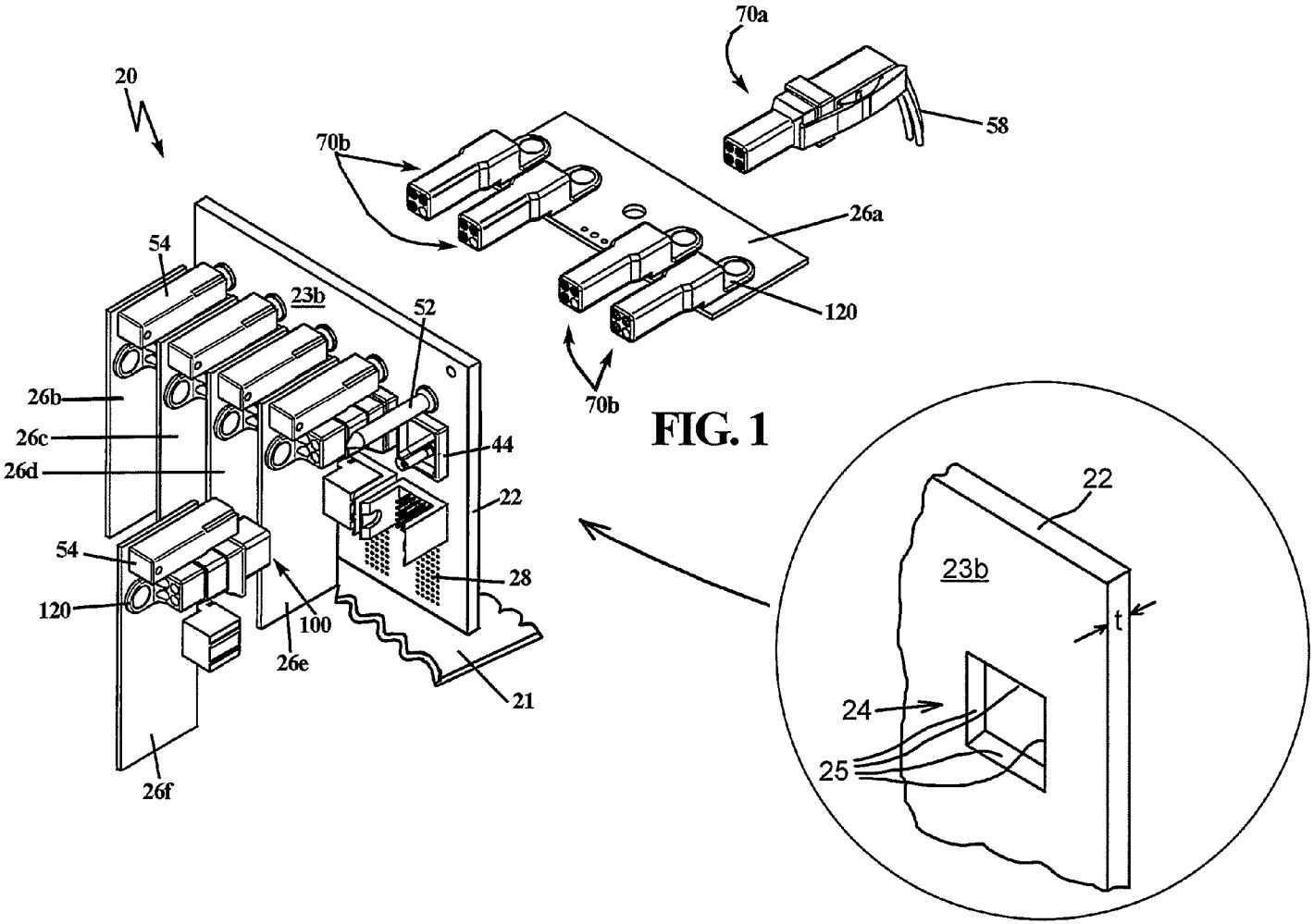
FIG. 1 is a perspective view of one embodiment of the apparatus of the invention for making an interconnection between power and signal cables on a mid- or backplane board showing a horizontal connector card to be connected to a plurality of vertical connector cards.
FIG. 1*a* is a close-up perspective view of one opening in the mid- or backplane board of FIG. 1, without the bushing.
Figure 2:
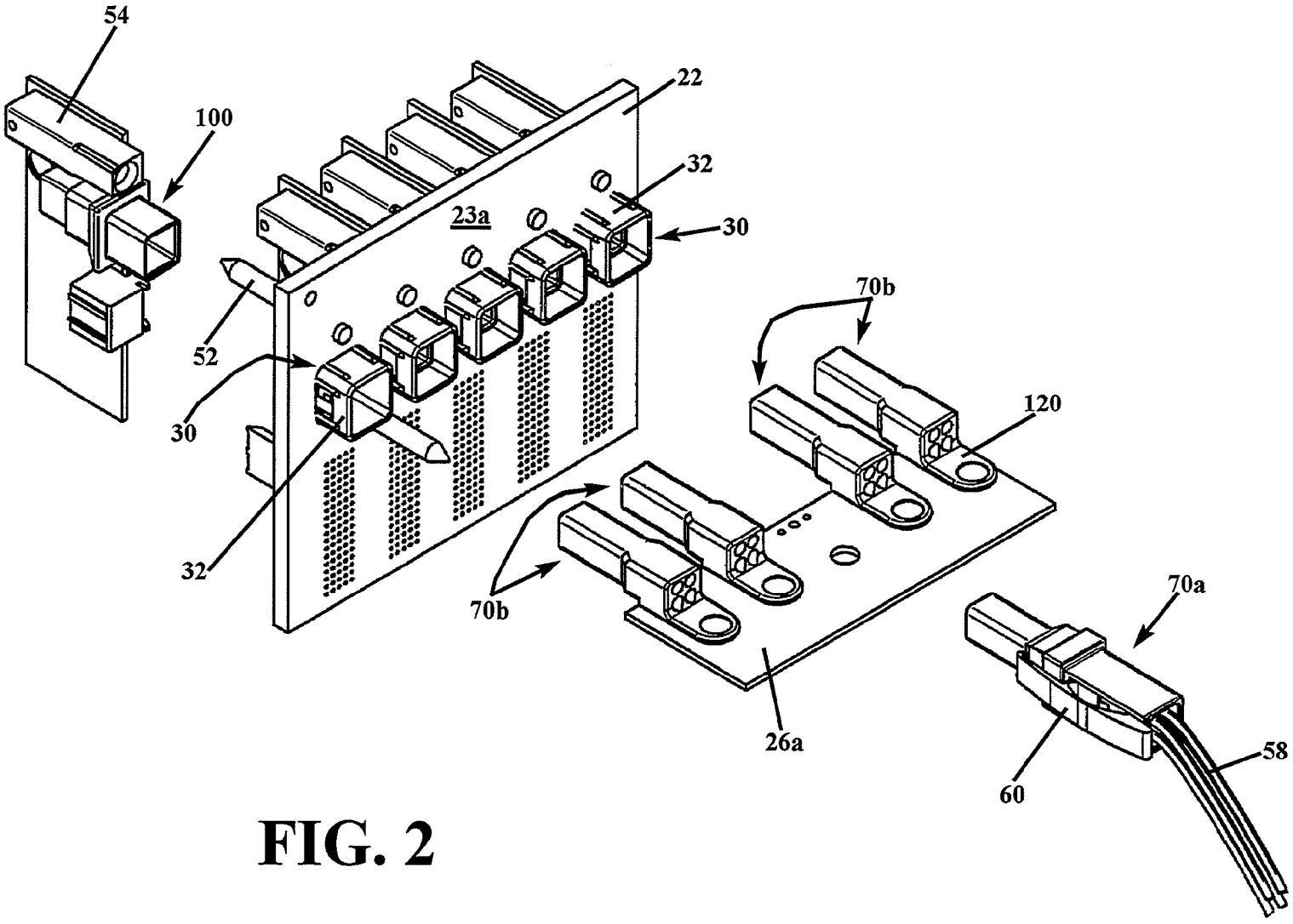
FIG. 2 is a perspective view of the apparatus of FIG. 1 showing the opposite side of the mid- or backplane board.

The present invention provides a method, system and apparatus for making an interconnection between power cables and signal cables, and is particularly useful for boards connecting coaxial cables for RF signals in excess of 16 GHz frequency, for example, in the range of, but not limited to, 16 GHz to 40 GHz. Electrical and electronic devices have need for internal interconnection of such power and signal cables, often using a generally planar mid- or backplane board 22 as seen in FIGS. 1 and 2 mounted vertically on the cage or other structure 21 of the device. These boards may have one, two or more openings through board 22, such as the five openings as shown in which connector plug bushings 30 are inserted. The openings may be of any relative orientation, and may be horizontally and/or vertically arranged to receive multiple connectors simultaneously from horizontally or vertically oriented connecting cards 26*a*, 26*b*, 26*c*, 26*d*, 26*e*, 26*f*, sometimes referred to as daughter cards, on either side 23*a*, 23*b* of the board. This permits vertical-vertical, horizontal-horizontal, or orthogonal vertical-horizontal orientation of the connecting cards on either side of the board. The interconnection of power and signal cables may be made on mid- or backplane boards (or both) of a horizontal connector card terminated at a cable end.

The board and connecting cards may be held in place on structure 21 by closing devices known in the art (not shown). The boards may be of varying thickness, or may have variations in a single thickness t, which make it difficult to achieve precise interconnection of the power or signal connectors. The openings in the board are substantially rectangular, and may be a square or close-to-square opening 24 as shown in FIG. 1*a* without the bushing. The board is generally made of a rigid material used for standard printed circuit boards such as FR4 glass-reinforced epoxy laminate sheets, and at least has rigid inward peripheral edges 25 around the opening. The board 22 may be replaced with any rigid structure such as an aluminum frame or a punched metal frame work to hold bushings 30 in place. The board may optionally include electrical components 28 mounted thereon.

To hold the power and/or signal connectors in proper orientation, there is employed in each opening 24 a connector plug bushing 30 as seen in more details on FIGS. 3-6. The bushing has an elongated body 32 of a predetermined desired length between opposite ends. The exterior of the body 32 is rectangular (e.g., square or close-to-square) to match opening 24 with four outer side walls 34 as seen in cross-section perpendicular to an axis along the length of the bushing, which axis is known as the connector axis 36. The bushings 30 are sized to be received in each of the board openings 24 orthogonal to the board 22. The bushing body 34 has an inner opening 38 extending straight through its length $l_1$ with four inner side walls 40 of rectangular cross-section as seen in cross-section perpendicular to the connector axis 36. The bushing body 32 functions as a sleeve configured to receive self-aligning, blind mate inter-mating male and female connector housings and plugs from one side of the board to the other, which are described in more detail below. It also functions to maintain the required maximum allowable disengagement distance between the mating connectors 70*a* and 100.

This disengagement distance is determined by the constant impedance design connector being employed in the system of the present invention. The widths w2 of the outer side walls of the bushing body are slightly less in horizontal and vertical directions than widths w1 of the board openings. The bushing body 32 continues the smaller outer width w2 to one end 42, to permit insertion into and through the board opening 24. At the opposite end of bushing 30, there is disposed an outwardly extending flange 44 which is larger than the openings, so that the flange 44 may butt up against the surface of board 22 and prevent further travel in that direction. The bushing may have a window 46 on one side of the bushing body 32 with a window edge 46*a* to receive a latch, as described further below.

Figure 3:
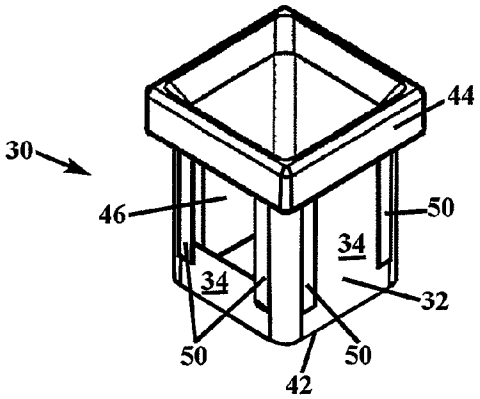
FIG. 3 is a perspective view of one embodiment of the connector plug bushing used in the mid- or backplane board of FIG. 1.
Figure 4:
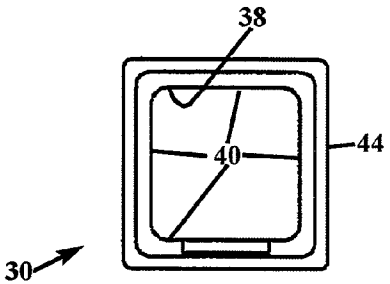
FIG. 4 is an end view of the connector plug bushing of FIG. 3.
Figure 5:
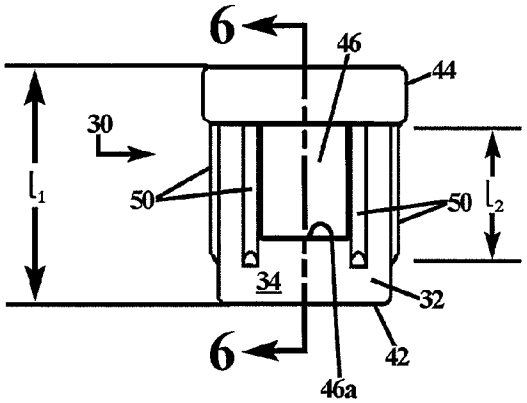
FIG. 5 is a side elevational view of the connector plug bushing of FIG. 3.
Figure 6:
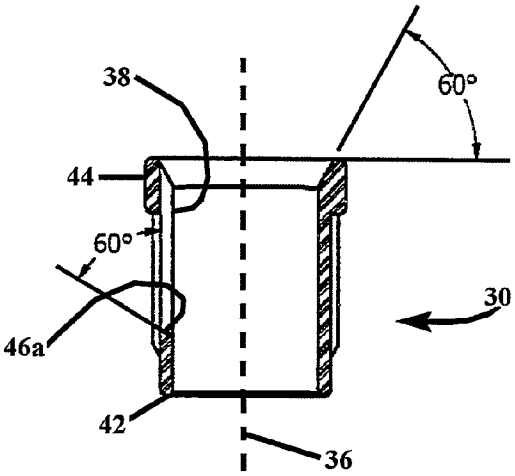
FIG. 6 is a cross-sectional elevational view of the connector plug bushing of FIG. 3, as seen along line 6-6 of FIG. 5.
Figure 8:
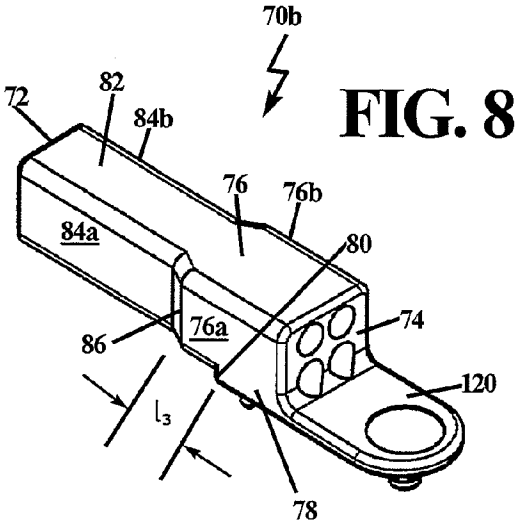
FIG. 8 is a perspective view of the male connector plug housing of FIG. 7 showing the opposite side and end of the housing.
Figure 10:
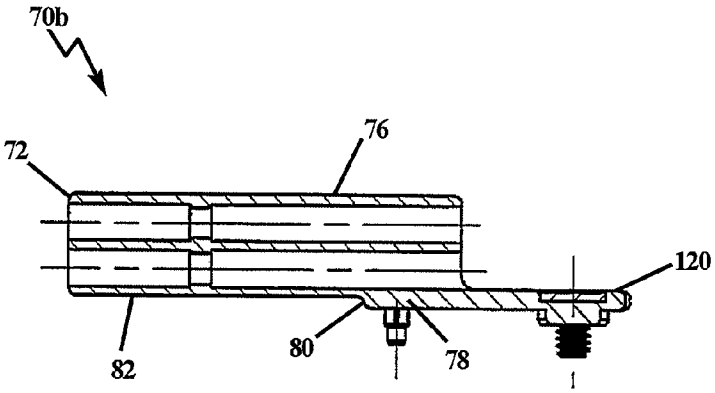
FIG. 10 is a cross-sectional elevational view of the male connector plug housing of FIG. 7, as seen along line 10-10 of FIG. 9.
Figure 7:
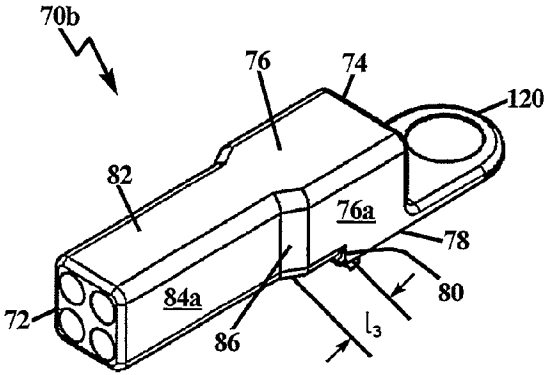
FIG. 7 is a perspective view of one embodiment of the male connector plug housing used in the mid- or backplane board of FIG. 1.
Figure 9:
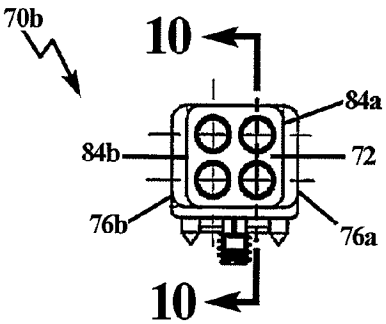
FIG. 9 is an end view of the male connector plug housing of FIG. 7.
Figure 12:
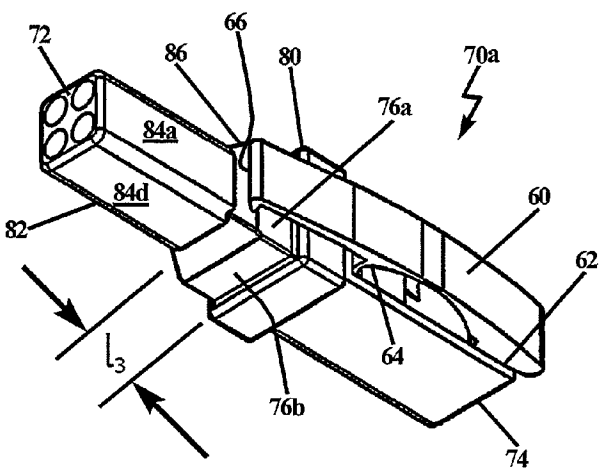
FIG. 12 is a perspective view of the male connector plug housing and latch of FIG. 11 showing the opposite side and end of the housing and clamp.
Figure 11:
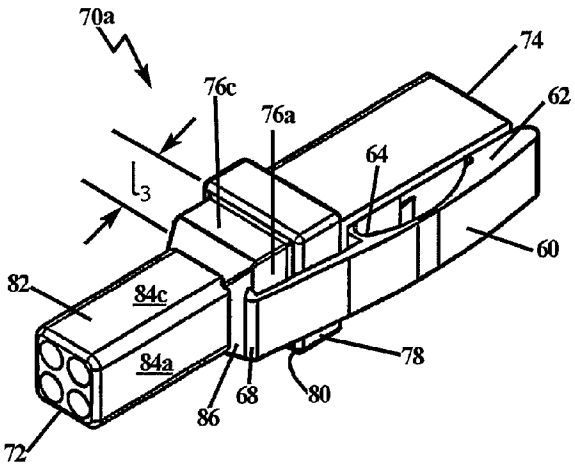
FIG. 11 is a perspective view of the male connector plug housing of FIG. 7 with one embodiment of a latch for securing to the connector plug bushing of FIG. 3.
Figure 14:
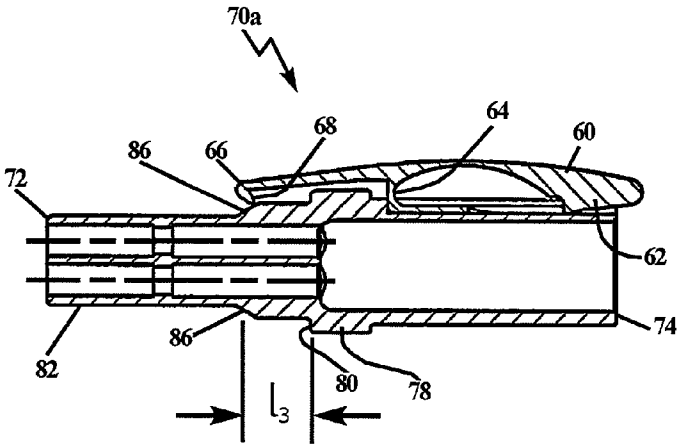
FIG. 14 is a cross-sectional elevational view of the connector plug housing and latch of FIG. 13, as seen along line 14-14 of FIG. 13.
Figure 13:
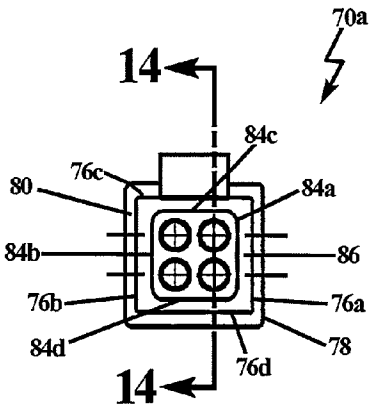
FIG. 13 is an end view of the connector plug housing and latch of FIG. 11.
Figure 16:
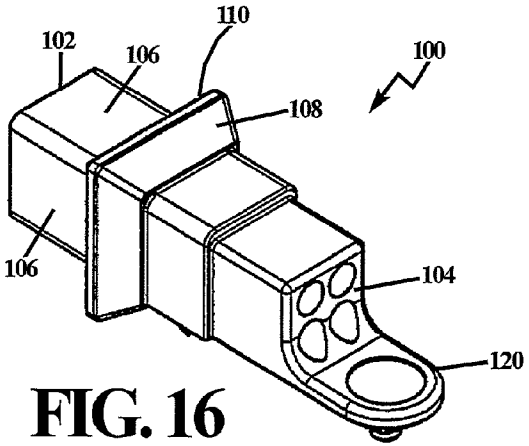
FIG. 16 is a perspective view of the female connector plug housing of FIG. 15 showing the opposite side and end of the housing.
Figure 15:
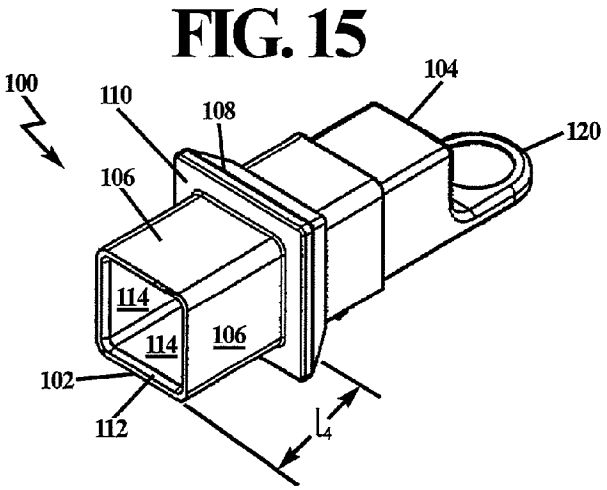
FIG. 15 is a perspective view of one embodiment of the female connector plug housing used in the mid- or backplane board of FIG. 1.
Figure 18:
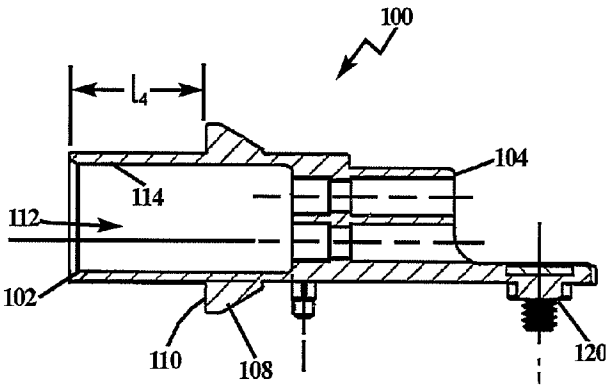
FIG. 18 is a cross-sectional elevational view of the female connector plug housing of FIG. 15, as seen along line 18-18 of FIG. 17.
Figure 17:
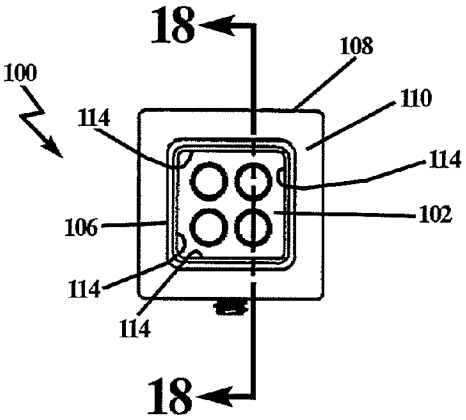
FIG. 17 is an end view of the female connector plug housing of FIG. 15.
Figure 20:
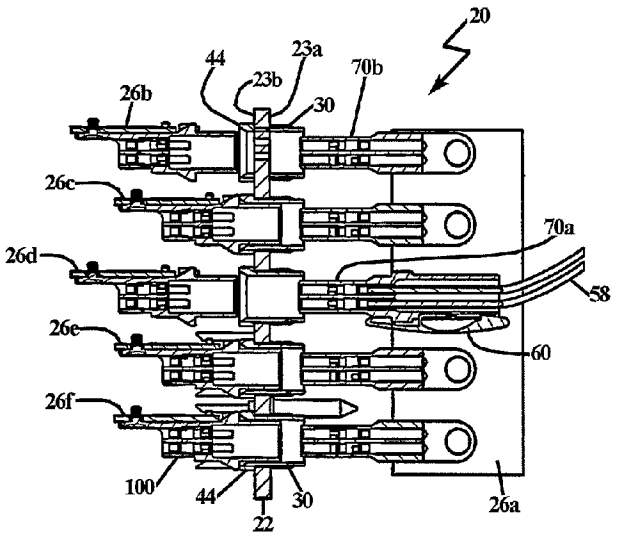
FIG. 20 is a top down cross-sectional view of the apparatus of FIG. 19, as seen along line 20-20 of FIG. 23.
Figure 19:
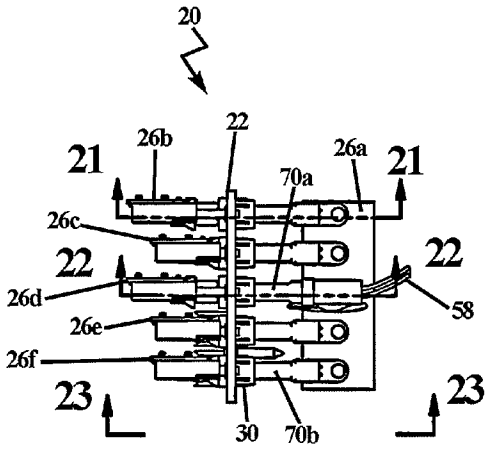
FIG. 19 is a top plan view of the apparatus of FIG. 1 with the male connector plug housings of a horizontal connector card in the process of being interconnected with the female connector plug housings of a plurality of vertical connector cards through the connector plug bushings of a mid-or backplane board.
Figure 23:
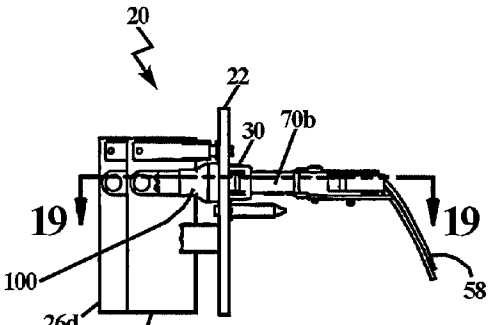
FIG. 23 is a side elevational view of the apparatus of FIG. 19, as seen along line 23-23 of FIG. 19.
Figure 22:
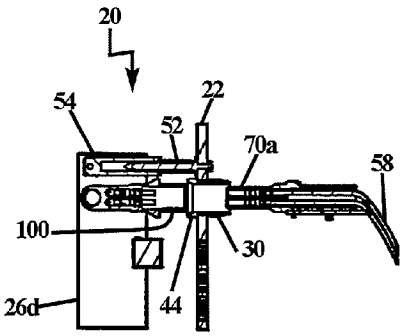
FIG. 22 is a side cross-sectional elevational view of the apparatus of FIG. 19, as seen along line 22-22 of FIG. 19.
Figure 21:
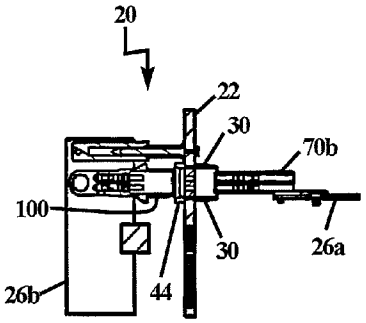
FIG. 21 is a side cross-sectional elevational view of the apparatus of FIG. 19, as seen along line 21-21 of FIG. 19.

To secure the bushing 30 in the board opening 24, the bushing body 32 includes at least one resilient outwardly and longitudinally extending tab 50 along at least a portion of the length of and on a side 34 of the bushing body. The bushing body 32 may include one or more of such elongated tabs 50 on some or all sides 34, such as a pair of spaced apart tabs on each side extending along the full length as shown in FIGS. 3 and 5. The bushing walls may have openings or window 46 adjacent or between the tabs.

The tab 50 has a length $l_2$ at least as long as the thickness of the board 22 at the opening 24, to accommodate thickness variations of a board, and are sized to provide a friction fit against the edges 25 of the board openings to hold the connector plug bushing 30 within the board opening. The bushing 30 may be made of a flexible polymer material, for example thermoplastics such as polybutylene terephthalate (PBT), polyoxymethylene (POM) (also known as Delrin), or other suitable dielectric or electrically insulating material, and the tabs 50 may be integrally formed as a single piece with the bushing body 32 and flange 44. The bushing needs to be supported by some structure to ensure alignment of the mating connectors, and may alternatively employ other means for connection to the board. In some instances, bushing 30 may even be used without the board to interconnect the male and female connector plug housings.

The connectable male and female connector plugs to be received and secured within the bushing body 30 comprise complimentary male and female connector plug housings with complimentary connector plugs in each. The male and female connector housings may be made of any suitable dielectric material, for example thermoplastics such as PBT or POM. One or more of these male and female connector plug housings are typically secured on a connecting card to be plugged into one side of the mid- or backplane board. The system of the present invention would typically employ one style of male plug 70*a* which is a cable end connection or the male plug connectors 70*b* (or both) which are board mounted. The example of FIGS. 1 and 2 shows a male connector plug housing 70*a* independent of connecting card 26*a*, and two connector plug housings 70*b* on each side, arranged horizontally and structurally mounted directly to connecting card 26*a*. As seen in FIGS. 7-10, structurally mounted male connector plug housing 70*b* has a free first end 72 and an opposite second end 74 for connection to a cable such as a power cable or a coaxial RF signal cable (not shown). The cables may be connected to electronic devices located on the connecting card 26*a*, may be connected to other male connector plug housings 70*b* on the card, or may be connected to electronic devices located elsewhere. The housing end 74 on male connector plug housing 70*b* also includes a mounting member 120 that structurally connects the housing to card 26*a*.

The male connector plug housing 70*b* has an outer rectangular cross-section surface 76 with four outer side walls located at a mid-portion between the ends 72, 74. The width between at least one pair of sides 76*a*, 76*b* is sized to be slightly smaller than the comparable dimension in the connector plug bushing inner opening 38, for example, about 0.03 in. less, to provide a sliding fit. The remaining sides of outer surface 76 need not have a close sliding fit within the bushing 30. The male connector plug housing 70*b* has an outwardly extending flange 78 adjacent the second end 74, i.e., a step on the underside of the outer surface nearer end 74, with the flange 78 forming a first shoulder 80 extending out from the outer surface 76. A male connector portion 82 of four-sided rectangular configuration extends rearward from the male connector plug housing free end 72 and has a width between sides 84*a*, 84*b* that is less than the width of the male connector plug housing outer surface 76*a*, 76*b* which provides the sliding fit with the bushing 30 interior. A second shoulder 86 is formed between the two different widths of male connector portion 82 and male connector plug housing outer surface 76*a*, 76*b*. The length $l_3$ of the male connector plug housing outer surface from the shoulder 80 of the flange 78 to shoulder 86 is less than the length $l_1$ of the bushing body. The top surface of male connector plug housing 70*b* is essentially flat between ends 72 and 74. In the free end of the male connector plug housing there is disposed one or more first connector plugs, here shown as a 2×2 matrix of plugs, although other size matrices are not precluded, for connection to a cable carrying power or signal (not shown), such as a coaxial cable with RF signals in the range of, but not limited to, DC to 40 GHz frequency.

To hold and removably secure the male connector plug housing 70*a* to the bushing, a latch may be provided for attachment to the receiving edge 46*a* on the connector plug bushing 30. A latch 60 is shown in FIGS. 11-14 in connection with independent male connection plug housing 70*a*, connected at end 74 to cable 58. Male connector plug housing 70*a* has no direct structural connection to card 26*a* in the exemplary embodiment shown. The example of the independent male connection plug housing 70*a* differs from the card-connected male connector plug housing 70*b* in that the former has a flange 78 with shoulder 80 that extends outward from the walls of the outer surface 76 in all directions. Also, the widths between all of the outer walls 76 (76*a*, 76*b*, 76*c*, 76*d*) is sized to be slightly smaller, for example, about 0.01 to 0.02 in. less, than the comparable inner dimensions of the bushing inner opening 38. Shoulder 86 is formed on all sides between outer walls 84*a*, 84*b*, 84*c*, 84*d* of male connector portion 82 and male connector plug housing outer surface 76. The shoulders 80 and 86 formed all around the exterior of housing 70*a* provide for a more robust physical connection with the connector plug bushing 30 and the female connector plug housing 100, since the connector plug housing 70*a* is not supported by connecting card 26*a*. Latch 60 provides the sole structural connection of male connector plug housing 70*a* to bushing 30.

Latch or clamp 60 may be disposed on one side of male connector plug housing 70*a*, with one end 62 of the clamp being secured to the male connector plug housing near end 74. The clamp extends toward the male connector plug housing free end 72, with a mid-point 64 contacting the housing. The latch free end 66 has an inwardly extending hook 68 for insertion onto the edge 46*a* of window 46 on a side of the connector plug bushing 30. The clamp may be made of a resilient, spring like metal or polymer material such as aluminum or stainless steel, PBT or POM, and the free end 66 and hook 68 are biased inward. The clamp has a length sufficient so that the hook 68 snaps into the bushing window edge 46*a* when the male connector plug housing 70*a* is inserted into the bushing 30 and the shoulder abuts the bushing end 42. The hook 68 may be removed and the male connector plug housing withdrawn by pressing the clamp 60 inward between the end 62 and mid-point 64 to rotate hook 68 out of bushing window edge 46*a*. One or more clamps may be used with either or both of power or signal connector plug housings 70*a*, 70*b*.

The female connector plug housing 100 as shown in FIGS. 15-18 has a free first end 102 and an opposite second end 104 for connection to a cable such as a power cable or a coaxial RF signal cable (not shown). Extending back from the female connector plug housing free end 102 is an outer rectangular cross-section surface with four outer side walls 106. The widths of each wall 106 are smaller than and sized to provide a sliding fit within the connector plug bushing inner opening, for example, about 0.03" less in width. An outwardly extending flange 108 is disposed on the female connector plug housing adjacent the second end, i.e., on the side of the outer surface nearer end 104, and the flange 108 forms a shoulder 110 extending from the outer surface 106. The length $l_4$ of the female connector plug housing outer surface 106 from the flange shoulder 110 to the free end 102 is less than or equal to the difference between the length $l_1$ of the bushing body and the length $l_3$ of the male connector plug housing outer surface. Extending inward from the female connector plug housing free end 102 is a female connector portion 112 of four-sided rectangular configuration which has widths of the inner side walls 114 less than the widths of the female connector plug housing outer surface 106. The female connector portion 112 is sized to receive within it the male connector portion 82 of the male connector plug housing 70. At the innermost end of the female connector portion there is disposed one or more second connector plugs, here shown as a 2×2 matrix of plugs, for connection to a cable carrying power or signal (not shown), such as a coaxial cable with RF signals in the range of, but not limited to, DC to 40 GHz frequency. Latch 60 may also be employed on the female connector plug housing in the manner described for the male connector plug housing, and with latch hook engagable with a suitable slot or edge in a window on the bushing 30, so that the hook snaps into place when the female connector plug housing is inserted into the bushing and the shoulder 110 abuts the end of the bushing.

A guide pin 52 may be provided on the board 22 adjacent a bushing 30 (FIGS. 1, 2, 19-23 and 27) extending perpendicular to the plane of the board to mate with the opening in a corresponding pin sleeve 54 on the connecting card 26 adjacent to a male or female connector plug housing 70 or 100. Insertion of the guide pin in the pin opening aligns the board and cards during assembly and interconnection of the connector plugs between the cards, and provides additional structural support of the assembled board and cards.

To assemble the interconnection of the present invention when used on a board or other structure, the connector plug bushings 30 are inserted into the openings of the mid- or backplane board 22 from side 23*b* orthogonal to the board and pushed inward until the body flange 44 contacts the board. The compression of the resilient tabs 50 on the bushing body provide the desired degree of friction fit against the edges of the board opening to secure each connector plug bushing within its respective board opening. The insertion of the male and female connector plug housings into the bushings 30 on board 22 are shown in FIGS. 19-23. Independent male connector plug housing 70*a* is inserted separately from the gang of connector plug housings 70*b* secured to card 26*a*. The free end of one of the male or female connector plug housing, whether or not secured on a connecting card, is inserted into the inner opening 38 of each connector plug bushing 30 from the smaller end 42 of the connector plug bushing body 32 until the shoulder contacts the end 42. If the male or female connector plug housing has a clamp, once the flange shoulder on the housing contacts the bushing body end, the latch hook snaps and is secured into the receiving edge 46*a* on the connector plug bushing window. The free end of the other male or female connector plug housing (which may not include a clamp) is inserted into the inner opening 38 of the connector plug bushing 30 from the flange 44 end until the flange shoulder on the other of the male or female connector plug housing contacts the connector plug bushing flange 44.

Figure 26:
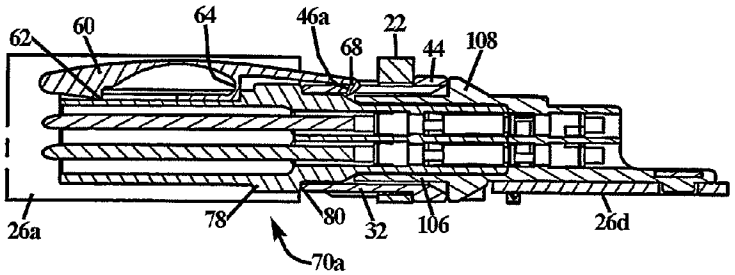
FIG. 26 is a cross-sectional view of the interconnected male and female connector plugs and bushing, as seen along lines 26-26 of FIG. 25.
Figure 27:
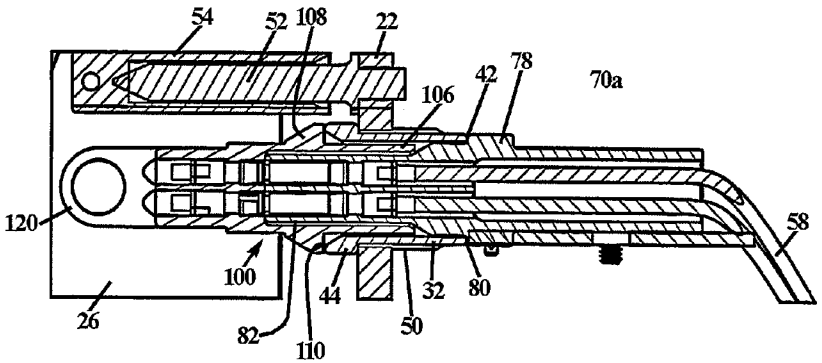
FIG. 27 is a cross-sectional view of the interconnected male and female connector plugs and bushing and secured structural pin of the connector card, as seen along lines 27-27 of FIG. 25.
Figure 24:
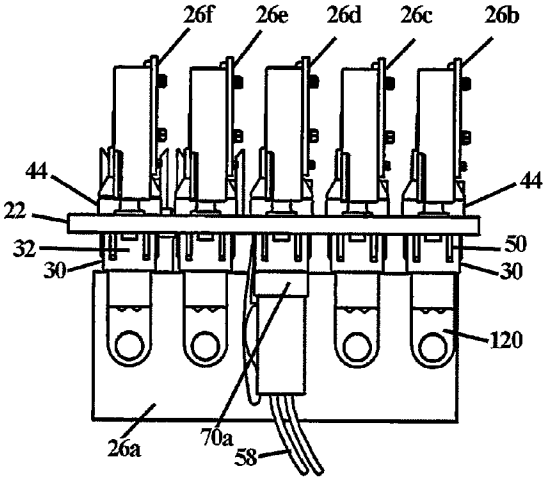
FIG. 24 is a top plan view of the apparatus of FIG. 19 with the male and female connector plug housings fully interconnected through the connector plug bushings of a mid-or backplane board.
Figure 25:
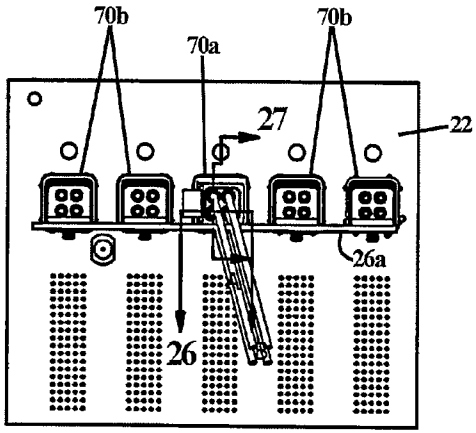
FIG. 25 is a rear elevational view of the apparatus of FIG. 24, as seen along lines 24-24 of FIG. 24.

During assembly the guide pins 52 extending from the board 22 mate with the guide pin openings on the cards 26 for structural support. As the male and female connector plug housings are fully inserted into the connector plug bushing, as shown in FIGS. 24, 26 and 27, the male portion 82 of the male connector plug housing 70 slides into the female portion 112 of the female connector plug housing 100 and the connector plugs are directly interconnected to one another. This then creates the desired single electrical interface in each connector plug pair for power or signal, without having to go through any additional connections on the board 22. The invention may be used with any combination of power and/or signal connections on the cards connecting through the mid- or backplane board. The cage structure 21 and closing devices will maintain a force on the opposing cards 26*a-f*. This will force the cards to be held in position axially maintaining the required maximum allowable disengagement distance. The maximum allowable disengagement distance for a cable end connection is maintain by this same structure and closing devices in combination with the latching action described for the connector plug housing 70*a*.

Figures 28A, 28B, 28C:
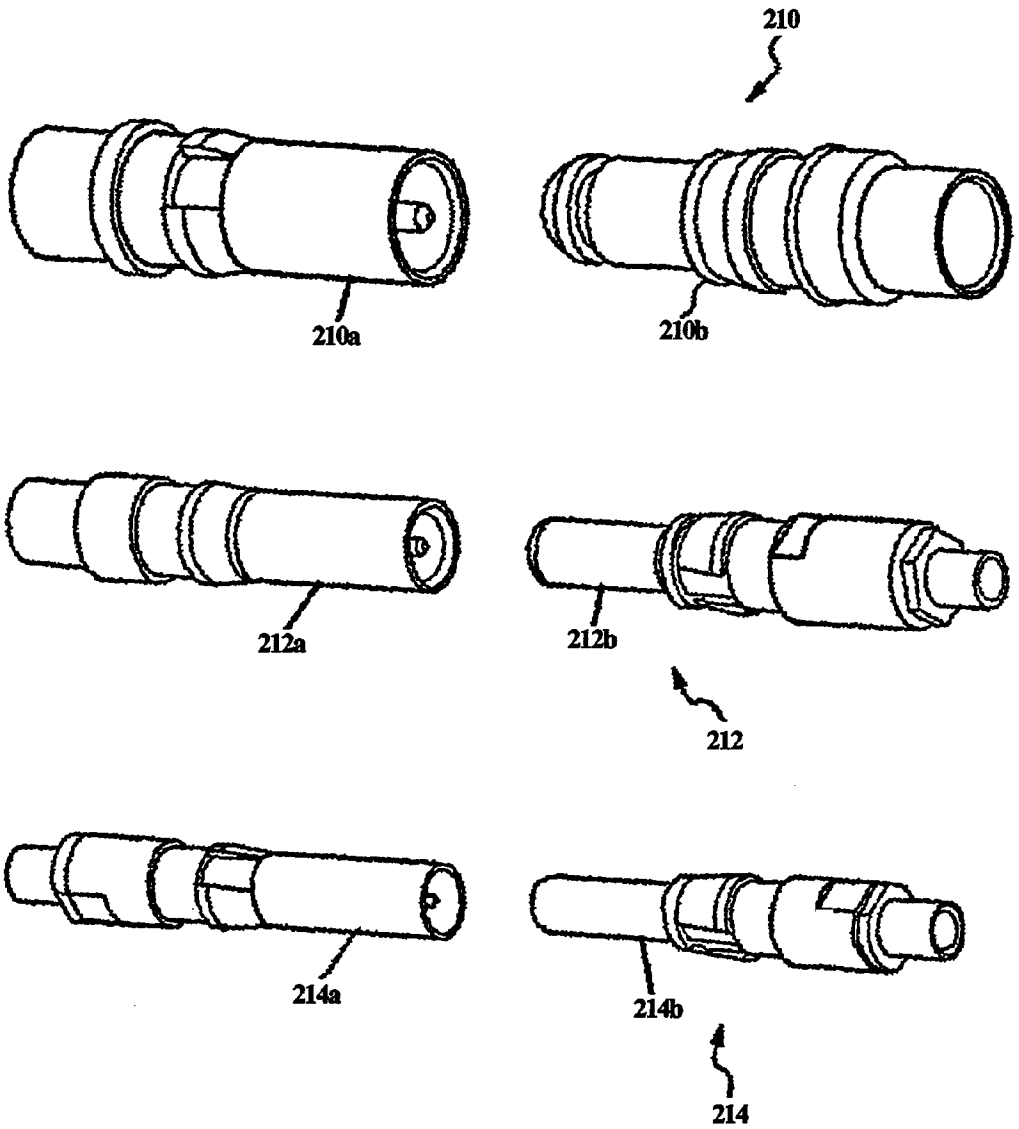
FIGS. 28A-C depict the various male and female connectors that are to be used in conjunction with the connector plug housings of the present invention.

FIGS. 28*a-c* depict the various male and female connectors plugs that are to be used in conjunction with the connector plug housings described above. It is desirable to utilize constant impedance connectors for coaxial cables carrying RF signals in the range of DC to 40 GHz. Constant impedance connectors minimize reflections, cross-talk, and attenuation.

A coaxial cable or connector as identified above has a characteristic impedance determined by the geometry of the cable or connector structure and the corresponding dielectric material between the conductors. The characteristic impedance may be represented by the formula:

$$Z=138(\epsilon)-\tfrac{1}{2}\log(D/d),$$

where,

Z is the impedance of the line;

D is the inner diameter of the outer contact;

d is the outer diameter of the inner contact; and $\epsilon$ is the relative dielectric constant.

Importantly, the connector must also exhibit this same impedance. Otherwise, signal disruption and reflections will degrade the signal quality due to the impedance mismatch. This is especially true in the higher frequency regimes, in applications where the signal frequency is on the order of 1 GHz and higher.

FIG. 28*a* is a perspective view of a size 8 constant impedance connector 210, having a female connector plug 210*a* and a male connector plug 210*b*.

FIG. 28*b* is a perspective view of a size 12 constant impedance connector 212. Connector 212 includes a female connector plug 212*a* and a male connector plug 212*b*.

FIG. 28*c* depicts a size 16 constant impedance connector 214, which is on the order of 57% smaller than the size 8 connector and 17% smaller than the size 12 connector. Connector 214 includes a female connector plug 214*a* and a male connector plug 214*b*.

The constant impedance function of each connector is the same. Consequently, the description for connector 210 shall apply equally to connectors 212 and 214. Any salient differences in connector designs will be addressed separately for each connector.

Each connector plug (male and female) is provided with an inner contact, an outer contact, and a dielectric spacer therebetween.

Figure 29:
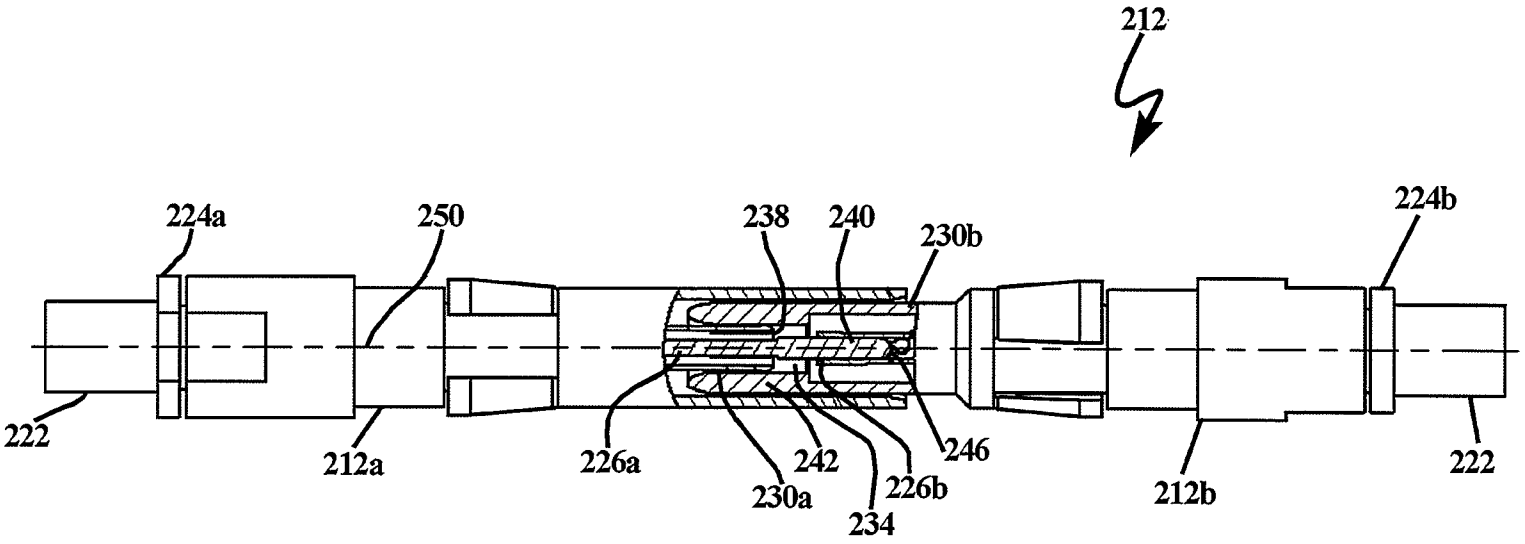
FIG. 29 depicts a cross-sectional view of a constant impedance male and female connector plugs to be incorporated within the connector plug housings of the present invention.

FIG. 29 depicts an exemplary cross-sectional view of a mating connector, specifically, connector 212, showing female connector plug 212*a* connected to, and in electrical communication with, male plug connector 212*b*. A coaxial cable 222 is joined at the male connector plug's fixed end 224*b*, and at the female connector plug's fixed end 224*a*. Although a coaxial cable connection is depicted, it is understood that the present invention does not preclude, nor is it limited to, direct connection to other electrical conduits, printed circuit boards, or discrete components. The female connector 212*a* includes an inner or center contact 226*a*, a dielectric spacer (not shown), and outer contact 230*a*. The inner contact 226*a* has an outer diameter and a free end 240. The free end 240 extends beyond the outer contact 230*a*. The outer contact 230*a* has an inner diameter, and a free end 238. The inner contact is coaxial with the outer contact. The inner contact free end 240 projects beyond the outer contact free end 238. The end may then be slightly compressed to make electrical contact with the free end of a mating outer contact.

Also depicted in FIG. 29 is a cross-sectional view of the complementary male connector plug 212*b* for mating with female plug 212*a*. Just as in the construction of the female plug, the inner and outer contacts of the male plug are of unequal lengths. However, in the male plug, the outer contact 230*b* is preferably longer and projects beyond the inner contact 226*b*. The mating male plug 212*b* generally has two defined regions for stepped diameters. The first is with respect to the inner contact outer diameter. The second is with respect to the outer contact inner diameter, which includes a two stage inner diameter, the first being the outer contact inner diameter corresponding to the inner contact outer diameter, and the second being the outer contact inner diameter that corresponds to the free end 240 of female plug 212*a* outer diameter of the female plug's inner contact. There is at least one dielectric spacer there between. Inner contact 226*b* is made to receive the inner contact free end 240 of the female plug. The inner diameter of inner contact 226*b* is at least as large as the outer diameter of the free end of the inner contact of the female plug 240. Similarly, the inner diameter of the male plug outer contact 230*b* is at least as large as the outer diameter of the outer contact of the female plug 230*a*.

The inner and outer contacts of the male connector plug and the female connector plug are of predetermined shape, and the material for the dielectric is chosen, such that when the male connector plug is engaged with the female connector plug, along the central axis 250 of the engaged connection, the effective outer diameter of the inner contact referenced by "d", the effective inner diameter of the outer contact referenced by "D", and the relative dielectric constant of the medium therebetween referenced by E, satisfy the equation:

$$Z=138(\epsilon)-\tfrac{1}{2}\log(D/d)$$

where

"Z" is the impedance.

The geometry is determined and the dielectric material selected so that anywhere along the central axis of the connector the impedance is substantially constant.

In this manner, a constant impedance connector allows for tolerances in the connector housings that may otherwise degrade electrical performance of the connectors.

In the present design, an electric signal passes through an overlap region in the connector between the two connector halves defined by the free end of the female plugs outer contact 238 mating with the outer contact 230*b* on the male plug. To achieve the desired constant impedance and correct operation at high frequency, the diameters of the inner and outer contacts are selected to match the desired impedance of the connector.

The inner and outer dimensions of a dielectric spacer and the associated conductor diameters throughout the connection region are adjusted to maintain constant impedance as the signal passes from one portion of the connection to the next over the length of the connector. For a dielectric material, in order to maintain constant impedance, the ratio of outer diameters to inner diameters for each region must be held constant. For changing dielectric mediums, for example from one dielectric medium to another, the following equality must be maintained:

$$(\epsilon 2)-\tfrac{1}{2}\log(D2/d2)=(\epsilon 1)-\tfrac{1}{2}\log(D1/d1)$$

where $\epsilon 1$ and $\epsilon 2$ are the relative dielectric constants for mediums 1 and 2, respectively.

As a signal passes through each region, as long as the above equality is maintained, the signal will propagate through mediums of constant and equal impedance as it does in the coaxial cable itself.

When the dielectric constants are the same throughout, only the ratios of the diameters are needed to maintain the impedance equality.

Figure 30:
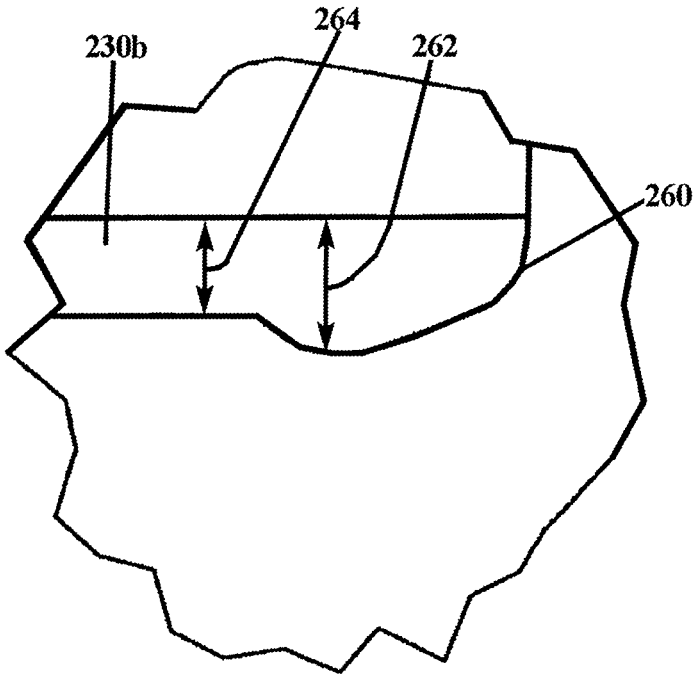
FIG. 30 depicts a cross-sectional view of the profile of the curved outer contact of the male connector plug of the present invention.

In addition to the above, in order to facilitate insertion and preserve the integrity of the electrical connection, the male connector plug outer contact 230*b* may include a contoured profile. FIG. 30 depicts a cross-sectional view of the profile of the curved outer contact. The tip 260 of outer contact 230*b* represents an extended upper portion of the outer contact with a radius 262 larger than the radius 264 of the lower portion of the outer contact. Radius 262 is variable in length, initially increasing in length as the tip head extends axially from the lower portion to the upper portion of the outer contact. At its maximum length, radius 262 then decreases approximately linearly as the tip extends from the maximum radial length to the topmost portion of the outer contact.

The present invention is particularly advantageous in that it provides a single electrical interface in mid- or backplane applications, and may accommodate a wide range of board thickness variations while maintaining the desired interface relationship. The invention is capable of supporting any standard mid- or backplane configuration: vertical-vertical, horizontal-horizontal and true orthogonal vertical-horizontal, and further supports "fixed", or "pluggable" cabled backplane applications. The invention is compliant with standard 2 mm Hard Metric and ATCA backplane system architectures. The daughter-card receptacle side of the system is designed to "drop into" a hard metric, Future Bus Plus system architecture with no modifications to the board beyond one additional mounting hole. The invention may be used for a mix of RF, power and signal interconnects, such as high quality RF transmission rates in excess of 25 GHz. The bushing and connector housings are scalable in contact count and contact size with adjustments in card spacing and are capable of maintaining a true orthogonal interface. The connector plug bushing of the invention may also be used without the boards as a direct cable-to-cable interconnect device.

When a constant impedance connector is used with the above-identified connector housings, tolerances in the mating plug connection are accommodated such that a less than perfect connection may still provide constant impedance for RF applications in the high frequency spectrum. The smaller connector may, for example, provide constant impedance through the full (0.050") mating zone.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for making an interconnection for power or signal cables, including RF signals having an operating frequency range of at least about 16 GHz to 40 GHz comprising:

a connector plug bushing having an elongated body of a predetermined length between opposite ends, the body having an inner rectangular cross-section opening through the length thereof configured to receive connected male and female connector plugs;

a male connector plug housing having a free first end and an opposite second end for connection to a coaxial cable, the male connector plug housing having an outer rectangular cross-section surface at a mid-portion with a width sized to provide a sliding fit within the connector plug bushing inner opening and an outwardly extending flange adjacent the second end, the male connector plug housing outer surface having a length from the flange less than the length of the bushing body, the male connector plug housing having a male portion with a width less than the width of the male connector plug housing outer surface extending therefrom to the male connector plug housing free end;

a first coaxial connector plug in the free end of the male connector plug housing for connection to a power or signal cable, such as coaxial cable for RF signals having an operating range of at least about 16 GHz to 40 GHz;

a female connector plug housing having a free first end and an opposite second end for connection to a coaxial cable, the female connector plug housing having an outer rectangular cross-section surface extending to the female connector plug housing free end with a width sized to provide a sliding fit within the connector plug bushing inner opening and an outwardly extending flange adjacent the second end, the female connector plug housing outer surface having a length from the flange no greater than the difference between the length of the bushing body and the length of the male connector plug housing outer surface, the female connector plug housing having a female portion of a width less than the width of the female connector plug housing outer surface extending inward from the female connector plug housing free end and sized to receive the male portion of the male connector plug housing;

a second coaxial connector plug in the free end of the female connector plug housing for connection to a power or signal cable, such as coaxial cable for RF signals having an operating range of at least 16 GHz to 40 GHz;

wherein the free end of one of the male or female connector plug housing may be inserted into the inner opening of the connector plug bushing from one end of the end of the connector plug bushing body until the flange on the male or female connector plug housing contacts the connector plug bushing body;

wherein the free end of the other of the male or female connector plug housing may be inserted into the inner opening of the connector plug bushing from the opposite end of the connector plug bushing body until the flange on the other of the male or female connector plug housing contacts the connector plug bushing body; and wherein the male portion of the male connector plug housing may be inserted into the female portion of the female connector plug housing and directly connecting the first and second coaxial connector plugs as a result of the insertion of the male and female connector plug housings into the inner opening of the connector plug bushing to create a connection through the connector plug bushing for power or signal cables, such as coaxial cables for RF signals having an operating range of at least 16 GHz to 40 GHz.

2. The apparatus of claim 1 further including a structure receiving and securing the connector plug bushing.

3. The apparatus of claim 2 wherein, a) the structure receiving and securing the connector plug bushing is a mid- or backplane board having an opening through a thickness of the board, and optionally including one or more additional openings horizontally or vertically arranged thereon, the opening being substantially rectangular and having rigid inward peripheral edges, the board optionally including electrical components mounted thereon; b) the connector plug bushing has an elongated body of a predetermined length between opposite ends sized to be received in the board openings orthogonal to the board, an outer rectangular cross-section slightly smaller than the board opening and an outwardly extending flange at one end thereof larger than the board opening, the bushing body further having at least one resilient outwardly extending tab along at least a portion of the length of and on one or more sides of the bushing body, the tab being sized to provide a friction fit against the edge of the board opening to hold the connector plug bushing within the board opening; c) wherein the connector plug bushing body may be inserted into an opening of the mid- or backplane board orthogonal to the board until the body outwardly extending flange contacts the board, the resilient outwardly extending tab on the bushing body providing a friction fit against the edge of the board opening to secure the connector plug bushing within the board opening; d) the free end of the one of the male or female connector plug housing may be inserted into the inner opening of the connector plug bushing from the end of the connector plug bushing body opposite the flange until the flange on the male or female connector plug housing having the clamp contacts the connector plug bushing body;

and e) the free end of the other of the male or female connector plug housing may be inserted into the inner opening of the connector plug bushing from the flange end of the connector plug bushing body until the flange on the other of the male or female connector plug housing contacts the connector plug bushing body.

4. The apparatus of claim 1 wherein, a) the connector plug bushing has an edge, and further including a clamp on the one of the male or female connector plug housing for attachment to the edge on the connector plug bushing, the clamp having a free end with a hook biased for insertion onto the edge on the connector plug bushing; b) the free end of the one of the male or female connector plug housing having the clamp may be inserted into the inner opening of the connector plug bushing from the end of the connector plug bushing body opposite the flange until the flange on the male or female connector plug housing having the clamp contacts the connector plug bushing body and the hook is inserted onto the bushing body window edge; and c) the free end of the other of the male or female connector plug housing may be inserted into the inner opening of the connector plug bushing from the end of the connector plug bushing body having the flange until the flange on the other of the male or female connector plug housing contacts the connector plug bushing body.

5. The apparatus of claim 1 wherein said first and second coaxial connector plugs form a constant impedance connection, each coaxial connector plug including:

an inner contact of having an outer diameter and a free end, an outer contact having an inner diameter and a free end, said inner contact coaxial with said outer contact, said inner and outer contact free ends coincident with said connector free end;

a fixed end attachable to a coaxial cable having a dielectric spacer between said inner and outer contacts, and extending up to said outer contact free end;

said connector plug housings engaging and electrically connecting said plugs;

wherein the inner and outer contacts of said plugs are shaped, and material for the dielectric spacers is chosen, such that when said connector plug housings engage said plugs along a central axis of the engaged connection the effective outer diameter of the inner contact referenced by "d", the effective inner diameter of the outer contact referenced by "D", and a relative dielectric constant of the medium therebetween referenced by $\epsilon$, satisfy the equation:

$Z=138(\epsilon)-\frac{1}{2}\log(D/d)$ where

"Z" is the impedance, and the impedance is substantially constant throughout the central axis of said engaged connection; and wherein, on one connector plug, said inner contact free end projects beyond said outer contact free end.

6. The apparatus of claim 1 wherein said first coaxial connector plug includes a female connector having a free end and a fixed end, said female connector comprising:

an outer contact having an inner diameter D1;

an inner contact having an outer diameter d1;

a portion of said inner contact extending beyond said outer contact at said female connector's free end and having a diameter d3;

wherein said male connector is adapted to connect with said second coaxial connector plug including said female connector, said male connector having an inner contact with an outer diameter d2, an outer contact with an inner diameter D2, wherein a portion of said outer contact extends beyond said inner contact free end, said portion of said outer contact extending beyond said inner contact having an inner diameter D3; and such that when said male connector is at least partially engaged with said female connector, the ratios of the diameters: D1/d1, D2/d2, and D3/d3 are substantially equal.

7. The apparatus of claim 5 wherein one of said outer contacts includes a tip having a variable radius, said radius increasing axially to a point of maximum radial length as said tip extends from a lower axial position towards said free end, then decreasing approximately linearly as said tip continues to extend from said point of maximum radial length to said free end.

8. A method of making an interconnection for power or signal cables, including RF signals having an operating range of at least 16 GHz to 40 GHz comprising:

providing a connector plug bushing having an elongated body of a predetermined length between opposite ends, the body having an inner rectangular cross-section opening through the length thereof configured to receive connected male and female connector plugs;

providing a male connector plug housing having a free first end and an opposite second end for connection to a coaxial cable, the male connector plug housing having an outer rectangular cross-section surface at a mid-portion with a width sized to provide a sliding fit within the connector plug bushing inner opening and an outwardly extending flange adjacent the second end, the male connector plug housing outer surface having a length from the flange less than the length of the bushing body, the male connector plug housing having a male portion with a width less than the width of the male connector plug housing outer surface extending therefrom to the male connector plug housing free end;

providing in the free end of the male connector plug housing a first coaxial connector plug for connection to a power or signal cable, such as coaxial cable for RF signals having an operating range of at least 16 GHz to 40 GHz;

providing a female connector plug housing having a free first end and an opposite second end for connection to a coaxial cable, the female connector plug housing having an outer rectangular cross-section surface extending to the female connector plug housing free end with a width sized to provide a sliding fit within the connector plug bushing inner opening and an outwardly extending flange adjacent the second end, the female connector plug housing outer surface having a length from the flange no greater than the difference between the length of the bushing body and the length of the male connector plug housing outer surface, the female connector plug housing having a female portion of a width less than the width of the female connector plug housing outer surface extending inward from the female connector plug housing free end and sized to receive the male portion of the male connector plug housing;

providing in the free end of the female connector plug housing a second coaxial connector plug for connection to a power or signal cable, such as coaxial cable for RF signals having an operating range of at least 16 GHz to 40 GHz;

inserting the free end of one of the male or female connector plug housing into the inner opening of the connector plug bushing until the flange on the one of the male or female connector plug housing contacts the connector plug bushing body;

inserting the free end of the other of the male or female connector plug housing into the inner opening of the connector plug bushing from the opposite end of the connector plug bushing body until the flange on the other of the male or female connector plug housing contacts the connector plug bushing body; and inserting the male portion of the male connector plug housing into the female portion of the female connector plug housing and directly connecting the first and second coaxial connector plugs as a result of the insertion of the male and female connector plug housings into the inner opening of the connector plug bushing to create a connection through the mid- or backplane board for power or signal cables, such as coaxial cables for RF signals having an operating range of at least 16 GHz to 40 GHz.

9. The method of claim 8 further including providing a structure for receiving and securing the connector plug bushing, and inserting the connector plug bushing body into the structure.

10. The method of claim 9 wherein a) the structure receiving and securing the connector plug bushing is a mid- or backplane board having an opening through a thickness of the board, and optionally including one or more additional openings horizontally or vertically arranged thereon, the opening being substantially rectangular and having rigid inward peripheral edges, the board optionally including electrical components mounted thereon; and b) the connector plug bushing has an elongated body of a predetermined length between opposite ends sized to be received in the board openings orthogonal to the board, an outer rectangular cross-section slightly smaller than the board opening and an outwardly extending flange at one end thereof larger than the board opening, the bushing body further having at least one resilient outwardly extending tab along at least a portion of the length of and on one or more sides of the bushing body, the tab being sized to provide a friction fit against the edge of the board opening to hold the connector plug bushing within the board opening; and including:

inserting the connector plug bushing body into an opening of the mid- or backplane board orthogonal to the board until the body outwardly extending flange contacts the board, the resilient outwardly extending tab on the bushing body providing a friction fit against the edge of the board opening to secure the connector plug bushing within the board opening;

inserting the free end of the one of the male or female connector plug housing into the inner opening of the connector plug bushing from the end of the connector plug bushing body opposite the flange until the flange on the male or female connector plug housing having the clamp contacts the connector plug bushing body; and inserting the free end of the other of the male or female connector plug housing into the inner opening of the connector plug bushing from the flange end of the connector plug bushing body until the flange on the other of the male or female connector plug housing contacts the connector plug bushing body.

11. The method of claim 8 wherein the connector plug bushing has an edge, and further including providing a clamp on the one of the male or female connector plug housing for attachment to the edge on the connector plug bushing, the clamp having a free end having a hook biased for insertion onto the edge on the connector plug bushing, and including:

inserting the free end of the one of the male or female connector plug housing having the clamp into the inner opening of the connector plug bushing from the end of the connector plug bushing body opposite the flange until the flange on the one of the male or female connector plug housing having the clamp contacts the connector plug bushing body; and inserting the free end of the other of the male or female connector plug housing into the inner opening of the connector plug bushing from the end of the connector plug bushing body having the flange until the flange on the other of the male or female connector plug housing contacts the connector plug bushing body.

12. The method of claim 8 including providing a constant impedance connector having said first and second coaxial connector plugs, each coaxial connector plug including:

an inner contact of having an outer diameter and a free end, an outer contact having an inner diameter and a free end, said inner contact coaxial with said outer contact, said inner and outer contact free ends coincident with said connector free end;

a fixed end attachable to a coaxial cable having a dielectric spacer between said inner and outer contacts, and extending up to said outer contact free end;

said connector plug housings engaging and electrically connecting said plugs;

wherein the inner and outer contacts of said plugs are shaped, and material for the dielectric spacers is chosen, such that when said connector plug housings engage said plugs, along a central axis of the engaged connection the effective outer diameter of the inner contact referenced by "d", the effective inner diameter of the outer contact referenced by "D", and a relative dielectric constant of the medium therebetween referenced by $\epsilon$, satisfy the equation:

$$Z=138(\epsilon)-\tfrac{1}{2}\log(D/d)$$

where

"Z" is the impedance, and the impedance is substantially constant throughout the central axis of said engaged connection; and wherein, on one connector plug, said inner contact free end projects beyond said outer contact free end.

13. The method of claim 8 including providing a constant impedance connector wherein said first coaxial connector plug includes a female connector having a free end and a fixed end, said female connector comprising:

an outer contact having an inner diameter D1;

an inner contact having an outer diameter d1;

a portion of said inner contact extending beyond said outer contact at said female connector's free end and having a diameter d3;

wherein said male connector is adapted to connect with said second coaxial connector plug including said female connector, said male connector having an inner contact with an outer diameter d2, an outer contact with an inner diameter D2, wherein a portion of said outer contact extends beyond said inner contact free end, said portion of said outer contact extending beyond said inner contact having an inner diameter D3; and such that when said male connector is at least partially engaged with said female connector, the ratios of the diameters: D1/d1, D2/d2, and D3/d3 are substantially equal.

14. A constant impedance connector comprising:

first and second coaxial connector plugs, each connector plug having an inner contact of an outer diameter and a free end, an outer contact having an inner diameter and a free end, said inner contact coaxial with said outer contact, said inner and outer contact free ends coincident with said connector free end;

a fixed end attachable to a coaxial cable having a dielectric spacer between said inner and outer contacts, and extending up to said outer contact free end;

said connector plugs engaging and in electrical communication;

wherein the inner and outer contacts of said plugs are shaped, and material for the dielectric spacers is chosen, such that when said connector engages said plugs along a central axis of the engaged connection the effective outer diameter of the inner contact referenced by "d", the effective inner diameter of the outer contact referenced by "D", and a relative dielectric constant of the medium there between referenced by $\epsilon$, satisfy the equation:

$$Z=138(\epsilon)-\tfrac{1}{2}\log(D/d)$$

where

"Z" is the impedance, and the impedance is substantially constant throughout the central axis of said engaged connection;

wherein, on at least one connector plug, said inner contact free end projects beyond said outer contact free end; and wherein one of said outer contacts includes a tip having a variable radius, said radius increasing axially to a point of maximum radial length as said tip extends from a lower axial position towards said free end, then decreasing approximately linearly as said tip continues to extend from said point of maximum radial length to said free end.

15. A constant impedance connector including a male connector plug and a female connector plug, said female connector plug having a free end and a fixed end, said female connector plug comprising:

an outer contact having an inner diameter D1;

an inner contact having an outer diameter d1;

a portion of said inner contact extending beyond said outer contact at said female connector's free end and having a diameter d3;

wherein said male connector plug is adapted to connect with said female connector plug, said male connector plug having an inner contact with an outer diameter d2, an outer contact with an inner diameter D2, wherein a portion of said outer contact extends beyond said inner contact free end, said portion of said outer contact extending beyond said inner contact having an inner diameter D3;

such that when said male connector is at least partially engaged with said female connector, the ratios of the diameters: D1/d1, D2/d2, and D3/d3 are substantially equal; and wherein an outer contacts of said male plug includes a tip having a variable radius, said radius increasing axially to a point of maximum radial length as said tip extends from a lower axial position towards said free end, then decreasing approximately linearly as said tip continues to extend from said point of maximum radial length to said free end.

* * * * *